United States Patent [19]

Lopez

[11] 3,987,453

[45] Oct. 19, 1976

[54] BALANCED EXCITER FOR WIDEBAND ANTENNA ELEMENT

[75] Inventor: Alfred R. Lopez, Commack, N.Y.

[73] Assignee: The United States of America as represented by the Secretary of the Air Force, Washington, D.C.

[22] Filed: Aug. 18, 1975

[21] Appl. No.: 606,039

[52] U.S. Cl. ..... 343/767; 343/789; 343/862

[51] Int. Cl.[2] ..... H01Q 13/10

[58] Field of Search ..... 343/769, 789, 862, 767

[56] References Cited

UNITED STATES PATENTS

| | | | |
|---|---|---|---|
| 2,611,865 | 9/1952 | Alford | 343/769 |
| 2,791,769 | 5/1957 | Lindenblad | 343/769 |
| 3,810,183 | 5/1974 | Krutsinger | 343/769 |

*Primary Examiner*—Eli Lieberman

*Attorney, Agent, or Firm*—Joseph E. Rusz; Willard R. Matthews, Jr.

[57] ABSTRACT

An apertured metallic ground plate antenna element having a high input impedance is driven from a lower impedance input transmission line by means of an exciter that provides broadband impedance transformation. The input transmission line is divided into two higher impedance feed lines that feed two parallel plate transmission lines. The parallel plate transmission lines are positioned in close proximity to the element aperture and are oriented to provide antenna excitation in series.

3 Claims, 2 Drawing Figures

BALANCED EXCITER FOR WIDEBAND ANTENNA ELEMENT

STATEMENT OF GOVERNMENT INTEREST

The invention described herein may be manufactured and used by or for the Government for governmental purposes without the payment of any royalty thereon.

BACKGROUND OF THE INVENTION

This invention relates to antenna element feed circuits, and in particular to exciters for energizing broadband, high impedance, slot antennas from lower impedance input transmission lines.

Apertured metallic ground plate type antenna elements (slot antennas, for instance) commonly have high input impedances. The input transmission lines that are used to feed these antenna elements have much lower impedances. A typical problem encountered by antenna designers is that of connecting an input 50 ohm line to excit an antenna element having a 200 ohm input impedance. The use of impedance matching devices and special circuits adds substantial cost and complexity to the antenna system. Furthermore, conventional approaches to the problem are often frequency dependent. The present invention is directed toward overcoming these problems through the use of a balanced exciter that effects both frequency independent impedance transformation and antenna element excitation.

SUMMARY OF THE INVENTION

The invention comprehends means for exciting a high input impedance antenna element from a lower impedance input transmission line. For example, a four-to-one impedance transformation may be achieved by using an exciter consisting of two coaxial transmission lines feeding two parallel plate transmission lines. The coaxial transmission lines are each of an impedance that is twice that of the input transmission line and one-half that of the antenna element. An impedance match is made with the input transmission line by connecting the coaxial transmission lines to it in parallel. An impedance match is made with the antenna element by orienting the parallel plate transmission lines for series excitation of the antenna.

It is a principal object of the invention to provide a new and improved balanced exciter for a wideband antenna element.

It is another object of the invention to provide a balanced exciter for an apertured metallic plate antenna element that effects an impedance transformation between the antenna element and its input transmission line.

It is another object of the invention to provide a balanced exciter of the type described that is frequency independent.

These, together with other objects, features and advantages of the invention, will become more readily apparent from the following detailed description taken in conjunction with the illustrated embodiment in the accompanying drawings.

DETAILED DESCRIPTION OF THE PREFERRED EMBODIMENT

The invention is an exciter for use in a wideband phased array antenna element. It provides an inherent broadband impedance transformation of four-to-one in the specific embodiment described hereinafter. A typical antenna element consisting of a below cutoff opening in a metallic ground plate will have a high input impedance, typically 200 ohms. The present invention comprehends an exciter capable of matching a lower impedance transmission line, for example, 50 ohms, to the higher impedance of the antenna element.

Figure 1:
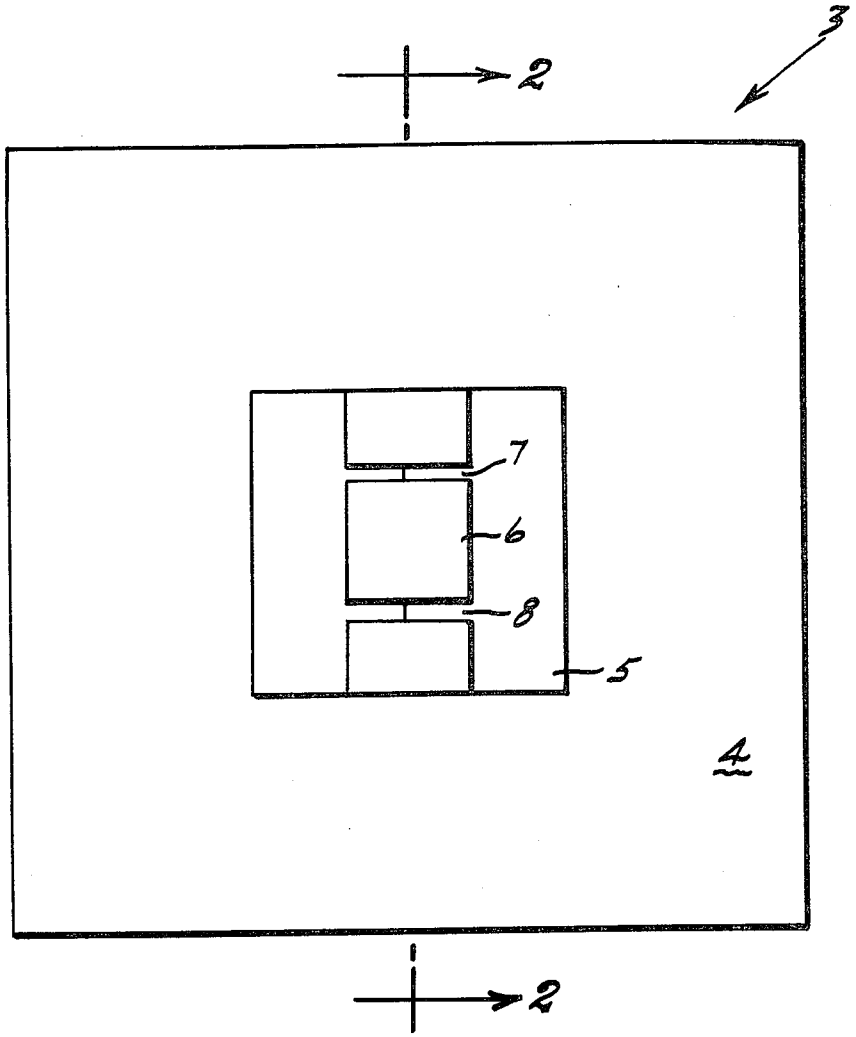
FIG. 1 is a plan view of one embodiment of the invention.
Figure 2:
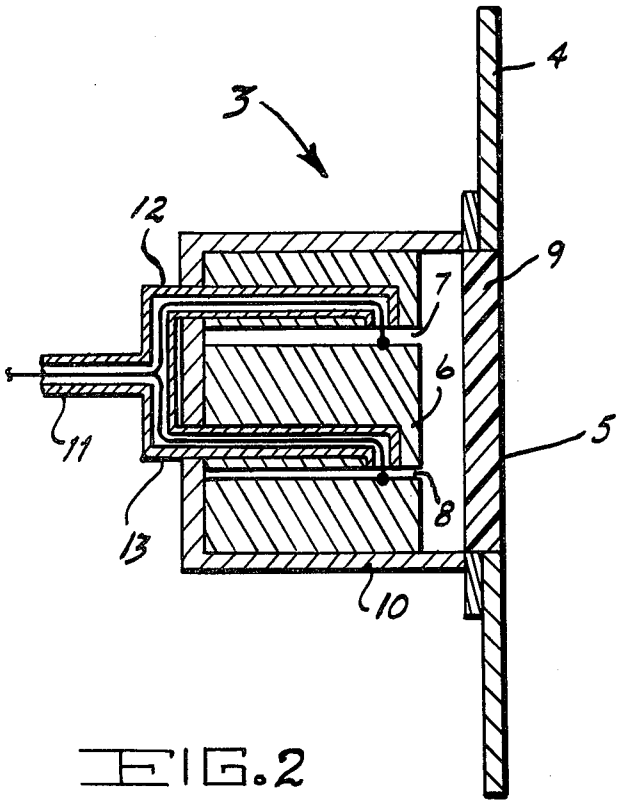
FIG. 2 is a sectional view of the embodiment of FIG. 1 taken at 2—2.

FIGS. 1 and 2 illustrate an antenna element and exciter constructed in accordance with the principles of the invention. Antenna element 3 consists of metallic ground plate 4, aperture 5 and dielectric aperture cover 9. FIG. 1 is illustrated with dielectric aperture cover 9 removed for clarity. The antenna element can also be provided with a metallic cavity backing 10. Parallel plate transmission lines 7, 8 are positioned as shown in close proximity to aperture 5 and are adapted to excite the antenna in response to signals from coaxial cable input transmission line 11. Parallel plate transmission lines 7, 8 can be fabricated by cutting appropriate slots in metallic block 6 in the manner illustrated or they can be constructed in any other conventional way. Input transmission line 11 is divided into coaxial transmission feed lines 12 and 13 which are connected to parallel plate transmission lines 7 and 8, respectively, as shown in FIG. 2 so as to cause antenna element 3 to be excited in series by transmission lines 7 and 8.

In accordance with the principle of the invention, in this embodiment coaxial transmission lines 12 and 13 are each of an impedance of one-half the antenna impedance and twice the input transmission line impedance. By way of example, in the case illustrated, the coaxial transmission lines 12, 13 can be taken as 100 ohms and the antenna element 3 impedance as 200 ohms. The 100 ohm coaxial cable transmission lines 12, 13 would then be used to excite high impedance parallel plate transmission lines 7, 8 with the 100 ohm line from each of the two parallel plate transmission lines connected in parallel to the input 50 ohm line 11. This balanced exciter therefore provides a frequency independent impedance transformation useful for exciting a phased array element which has an impedance of four times the impedance of the input transmission line.

While the invention has been described in one presently preferred embodiment, it is understood that the words which have been used are words of description rather than words of limitation and that changes within the purview of the appended claims may be made without departing from the scope and spirit of the invention in its broader aspects.

What is claimed is:

1. In combination with an antenna element consisting of a metallic ground plate having an aperture therein, a balanced exciter comprising first and second parallel plate transmission lines disposed in close proximity to said aperture, a coaxial cable input transmission line, and means bifurcating said coaxial cable input transmission line into first and second coaxial cable feed transmission lines, said first coaxial cable feed transmission line being connected to energize said first parallel plate transmission line and said second coaxial cable feed transmission line being connected to energize said second parallel plate transmission line.

2. A balanced exciter as defined in claim 1 wherein said first and second parallel plate transmission lines are oriented to provide series excitation of said antenna element.

3. A balanced exciter as defined in claim 2 wherein the impedance of each said feed transmission line is approximately one-half the impedance of said antenna element and approximately twice the impedance of said input transmission line.

* * * * *